US007545104B2

(12) United States Patent
Maishima

(10) Patent No.: US 7,545,104 B2
(45) Date of Patent: Jun. 9, 2009

(54) POWER SUPPLY CIRCUIT FOR FLASH DISCHARGE TUBE

(75) Inventor: Mitsuyoshi Maishima, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 11/450,322

(22) Filed: Jun. 12, 2006

(65) Prior Publication Data

US 2006/0226789 A1 Oct. 12, 2006

Related U.S. Application Data

(63) Continuation of application No. 10/835,570, filed on Apr. 30, 2004, now Pat. No. 7,081,718, which is a continuation-in-part of application No. PCT/JP02/11300, filed on Oct. 30, 2002.

(30) Foreign Application Priority Data

Oct. 31, 2001 (JP) ..... P2001-335395

(51) Int. Cl.
*H05B 37/00* (2006.01)

(52) U.S. Cl. ..... 315/241 P; 315/241 S

(58) Field of Classification Search ..... 315/241 S, 315/241 P, 241 R, 200 A
See application file for complete search history.

(56) References Cited

U.S. PATENT DOCUMENTS

| | | | | |
|---|---|---|---|---|
| 4,748,382 | A * | 5/1988 | Walker | 315/241 P |
| 4,942,340 | A * | 7/1990 | Ikawa | 315/241 P |
| 5,023,470 | A * | 6/1991 | Onozuka et al. | 307/108 |
| 5,387,849 | A | 2/1995 | Sridharan | 315/247 |
| 5,570,077 | A | 10/1996 | Swieboda | 340/331 |
| 6,005,352 | A * | 12/1999 | Odaka | 315/209 R |
| 6,518,711 | B2 | 2/2003 | Chao | 315/209 |
| 6,724,155 | B1 | 4/2004 | Flory, IV et al. | 315/289 |

FOREIGN PATENT DOCUMENTS

| | | |
|---|---|---|
| CN | 1156842 | 8/1997 |
| JP | 48-3535 | 1/1973 |
| JP | 56-140198 | 10/1981 |
| JP | 59-126519 | 7/1984 |
| JP | 59-137936 | 8/1984 |
| JP | 62-194241 | 8/1987 |

(Continued)

OTHER PUBLICATIONS

PCN Resistors Catalogue, 2001, Rev. 1.

(Continued)

*Primary Examiner*—Trinh V Dinh
*Assistant Examiner*—Dieu Hien T Duong
(74) *Attorney, Agent, or Firm*—Drinker Biddle & Reath LLP

(57) ABSTRACT

A voltage is applied across the positive electrode and negative electrode of a flash discharge tube (xenon flash lamp) to emit light by a charge and discharge capacitor. This voltage application accumulates energy in a residual inductance existing in the circuit constructed by the flash discharge tube and the power supply circuit for the flash discharge tube. This energy is made to flow as surge current into a series circuit comprising the flash discharge tube, a surge current diode and a diode protecting resistor.

4 Claims, 9 Drawing Sheets

FOREIGN PATENT DOCUMENTS

| | | |
|---|---|---|
| JP | 05-216099 | 8/1993 |
| JP | 6-46197 | 11/1994 |
| JP | 07-130485 | 5/1995 |
| JP | 07-175533 | 7/1995 |
| JP | 2001-215581 | 8/2001 |
| WO | WO 82/03913 | 11/1982 |
| WO | WO 00/56126 | 9/2000 |

OTHER PUBLICATIONS

Chinese Office Action (w/English translation) dated Mar. 13, 2009.

* cited by examiner

POWER SUPPLY CIRCUIT FOR FLASH DISCHARGE TUBE

RELATED APPLICATIONS

This application is a continuation application of application Ser. No. 10/835,570 filed Apr. 30, 2004, now U.S. Pat. No. 7,081,718 which is a Continuation-in-Part application of International Patent Application Serial No. PCT/JP02/11300 filed on 30 Oct. 2002, each application being incorporated by reference herein in the entirety.

BACKGROUND OF THE INVENTION

1. Field of the Invention

The present invention relates to a power supply circuit for a flash discharge tube used to make a flash discharge tube such as a xenon flash lamp emit light.

2. Related Background Art

A flash discharge tube represented by a xenon flash lamp is widely used as a light source for spectroscopic analysis, a light source for a flash lamp of a camera, a lamp for a high-speed shutter camera or the like because the spectral characteristics of the output light thereof are approximate to sunlight and it can provide stable flash light having a very short light-emission duration. Rare gas such as xenon or the like is filled in such a flash discharge tube. By applying high-voltage pulse current to a trigger electrode disposed in the discharge tube, electrical breakdown is partially induced to form a route through which current flows, and main discharging charges flow from a negative electrode to a positive electrode along this route, so that ionized rare gas induces arc luminescence and light is emitted to the outside. Here, large current is required to be instantaneously supplied for the main discharge, and thus there is normally adopted such a method that a required amount of electricity is charged in a capacitor for the main discharge in advance, and current is supplied from the main discharging capacitor at the light emission time.

Residual inductance occurs in the electrical circuit constructed by the power supply circuit and the flash discharge tube after light is emitted in the discharge tube. Since a large amount of current is supplied to the flash discharge tube as described above, high energy is accumulated in the residual inductance after the light emission of the flash discharge tube. In order to counter this, a surge current diode having a cathode connected to the positive electrode of the flash discharge tube and an anode connected to the negative electrode of the flash discharge tube is secured to the power supply circuit. The energy accumulated in the residual inductance in the power supply circuit is led as surge current to the circuit comprising the surge current diode and the flash discharge tube to drain the energy and suppress excessive accumulation of the energy.

SUMMARY OF THE INVENTION

The flash discharge tubes which emit light with large power such as 150 watts or the like is well known, and according to these flash discharge tubes, large current of 1000 to 1500 amperes flow in from the discharging capacitor into the flash discharge tube at the instant when light is emitted. In connection with this, the energy accumulated in the residual inductance is increased and the surge current is also increased to a large current of 100 amperes, so that there occurs a problem that the surge current diode generates heat or suffers breakdown, reliability is degraded or a failure rate is increased. If the permissible current of the surge current diode is increased, heat generation of the surge current diode, etc., can be prevented even when the surge current becomes excessive. However, this causes a large-size design of the surge current diode and thus a large-size design of the power supply circuit.

The present invention has an object to provide a power supply circuit for a flash discharge tube which can prevent heat generation of the surge current diode, etc., due to surge current.

In order to solve the above problem, a power supply circuit for a flash discharge tube according to the present invention is a power supply circuit for supplying the electric charges for light emission to a flash discharge tube having a positive electrode, a negative electrode and a trigger electrode by a charge and discharge capacitor, comprises of a surge circuit constituted by a first resistor and a diode connected in series. The surge circuit is disposed between the negative electrode and positive electrode of the flash discharge tube and connected in parallel to the charge and discharge capacitor. And the cathode side of the diode is connected to the positive electrode side of the flash discharge tube.

As described above, the surge circuit for drain energy by passing surge current is constructed by the diode and the first resistor, whereby the current value flowing through the diode can be reduced. This is effective in the protection of the diode.

A transformer disposed between the charge and discharge capacitor and the power source to boost the voltage supplied to the charge and discharge capacitor may be provided, and a switching element or a second resistor may be connected in series in the circuit formed by the transformer and the charge and discharge capacitor. When using the switching element, it is required to control the switching element so that it is turned on during charge of the charge and discharge capacitor and turned off in other cases.

When the charge and discharge capacitor is charged through the transformer, a part of the surge current at the time when the surge current occurs may flow into the transformer, so that the transformer may generate heat or be damaged by flow of large current thereto. By providing only the switching element and connecting the transformer and the charge and discharge capacitor to each other only during the charge of the charge and discharge capacitor, the transformer can be separated from the surge circuit at a time when the surge current occurs. Therefore, no large current flows in the transformer. Furthermore, when only the second resistor is provided, the surge current flowing in the transformer can be reduced. Furthermore, if both are connected to each other in parallel, an effect can be achieved that quick charging can be performed, and the surge current flowing in the transformer can be reduced.

DESCRIPTION OF THE PREFERRED EMBODIMENTS

Figure 1:
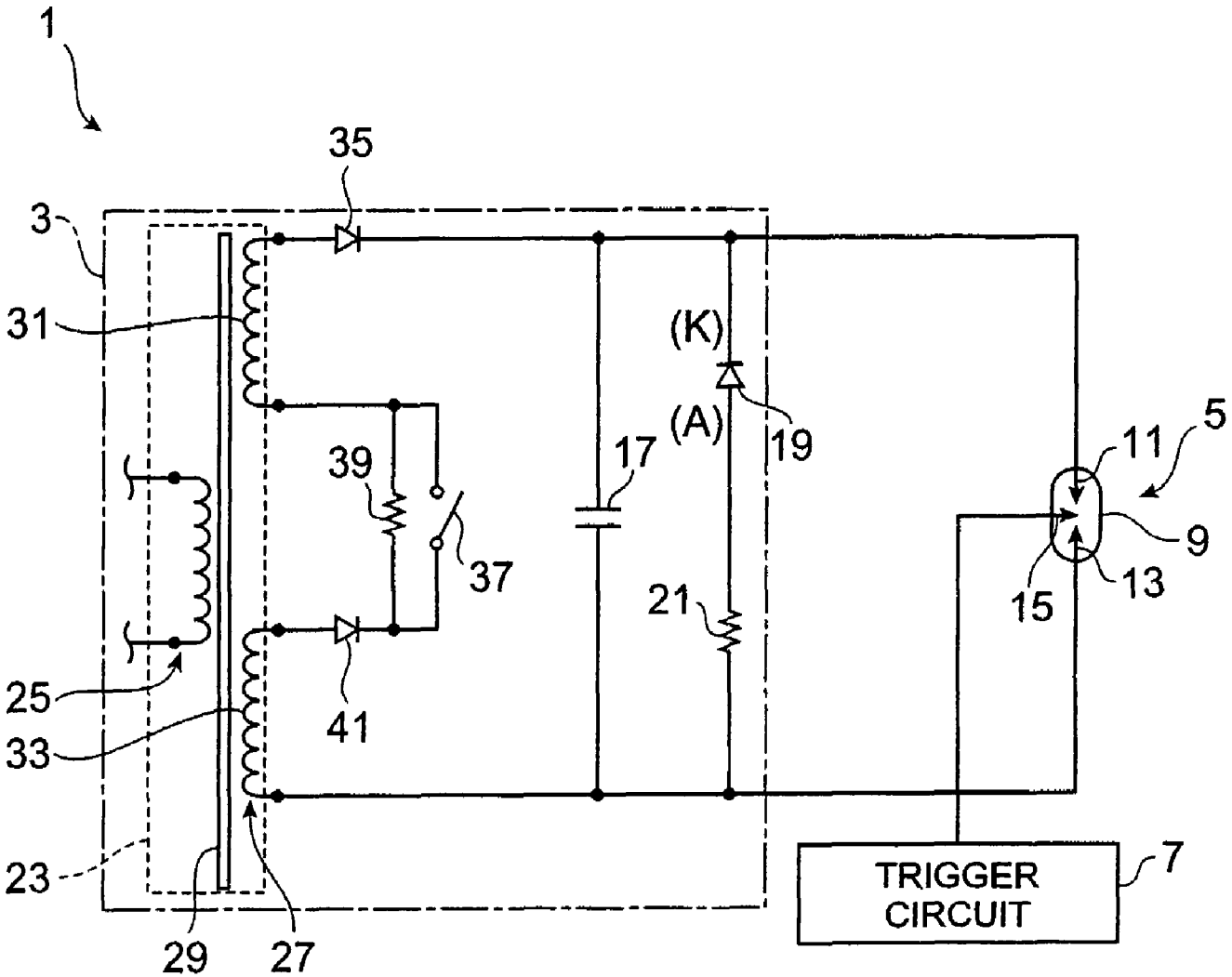
FIG. 1 is a circuit diagram showing the construction of a flash discharge tube apparatus containing a first embodiment of a power supply circuit for a flash discharge tube according to the present invention.

Preferred embodiments according to the present invention will be described hereunder in detail with reference to the accompanying drawings. To facilitate the comprehension of the explanation, the same reference numerals denote the same parts, where possible, throughout the drawings, and a repeated explanation will be omitted.

FIG. 1 is a circuit diagram showing the construction of a flash discharge tube apparatus 1 containing a first embodiment of a power supply circuit for a flash discharge tube according to the present invention. The flash discharge tube apparatus 1 comprises of a power supply circuit 3 for a flash discharge tube of this embodiment, a flash discharge tube 5 and a light emission trigger circuit 7. The flash discharge tube 5 is a gas discharge tube in which rare gas is filled, and, for example, it is a xenon flash lamp. The flash discharge tube 5 has a cylindrical type glass container 9, and a positive electrode 11, a cathode 13 and a trigger electrode 15 which are disposed in the container 9. Xenon gas is filled in the glass container 9.

The trigger electrode 15 of the flash discharge tube 5 is connected to the light emission trigger circuit 7. A trigger voltage when the flash discharge tube 5 is made to emit light by the light emission trigger circuit 7 is applied to the trigger electrode 15.

The positive electrode 11 and the cathode 13 of the flash discharge tube 5 are connected to the charge and discharge capacitor 17. By discharging the charge and discharge capacitor 17, the charges thus accumulated are supplied to the flash discharge tube 5, and the flash discharge tube 5 emits light derived from the charges thus supplied. The power supply circuit 3 for the flash discharge tube has a surge current diode 19, the cathode K of the surge current diode 19 is connected to the positive electrode 11 of the flash discharge tube 5, and the anode A of the surge current diode 19 is connected to the cathode 13 of the flash discharge tube 5 through the diode protecting resistor 21. As described above, the flash discharge tube 5, the surge current diode 19 and the diode protecting resistor 21 are mutually connected to one another in series to construct the surge circuit connected in series to the flash discharge tube 5.

When the wires, etc., of the flash discharge tube apparatus 1 becomes long, the resistance of the wires, etc., becomes not negligible, and the residual inductance is increased. Furthermore, as the energy used for the light emission of the flash discharge tube 5 is increased, the energy accumulated in the residual inductance is also increased. Therefore, the energy accumulated in the residual inductance through the light emission of the flash discharge tube 5 is made to flow into the series circuit comprising the flash discharge tube 5, the surge current diode 19 and the diode protecting resistor 21 and drained as surge current, thereby preventing accumulation of the energy. In this embodiment, the surge current diode 19 and the diode protecting resistor 21 are connected to each other in series to make the surge current flow into the diode protection resistor 21, thereby reducing the peak value of the surge current flowing into the surge current diode 19. The flash discharge tube 5, the charge and discharge capacitor 17, the surge current diode 19 and the diode protecting resistor 21 are mutually connected to one another by electric wires or wires on a printed circuit board.

The anode 11 of the flash discharge tube 5, the cathode of the surge current diode 19 and one electrode of the charge and discharge capacitor 17 is connected to the cathode of the rectifier diode 35. The anode of the rectifier diode 35 is connected to one end portion of a secondary coil 27 of the transformer 23 of the power supply circuit 3 for the flash discharge tube Here, the secondary coil 27 comprises a first coil portion 31 and a second coil portion 33 which are connected in series, and one end portion of the first coil portion 31 (that is, one end portion of the secondary coil 27) and the anode of the rectifier diode 35 are connected to each other.

The other end portion of the first coil portion 31 is connected to the cathode of the rectifier diode 41 through a switching element 37 and a transformer protecting resistor 39 which are connected in parallel. The current based on the voltage occurring in the transformer 23 flows in only one direction by the rectifier diode 41 and the rectifier diode 35 described above.

In this embodiment, the peak value of the surge current corresponding to counter current flowing in the transformer 23 at the time of occurrence of the surge current can be reduced by the switching element 37 and the transformer protecting resistor 39. For example, a semiconductor switch (thyristor, electric field effect transistor, bipolar transistor, IGBT or the like) may be used as the switching element 37. A metal clad coil resistor for power is used as the transformer protecting resistor 39 and the diode protecting resistor 21, and this is a small-size large-power resistor having excellent radiation of internal heat generation because of heat-resistant silicon mold (noninflammable). This resistor is disclosed in a catalog (2001 Rev. 1 PCN RESISTORS) of PCN Corporation. The metal clad coil resistor for power is excellent in performance to dissipate the heat generated in the resistor, and thus it is favorable for this embodiment.

The anode of the rectifier diode 41 is connected to one end portion of the second coil portion 33. The other end portion of the second coil portion 33 is connected to the cathode 13 of the flash discharge tube 5, the diode protecting resistor 21 and the other electrode of the charge and discharge capacitor 17.

The secondary coil 27 of the transformer 23 is electromagnetically coupled to the primary coil 25 through a core 29. The primary coil 25 is connected to a transformer driving circuit not shown. The flash discharge tube 5 emits light with large power such as 150 watts. In order to shorten the light emission interval, the charge time of the charge and discharge capacitor 17 is required to be shortened, and thus it is necessary to supply large current. Therefore, a high voltage is generated by the transformer 23 to charge the charge and discharge capacitor 17.

Figure 2A:
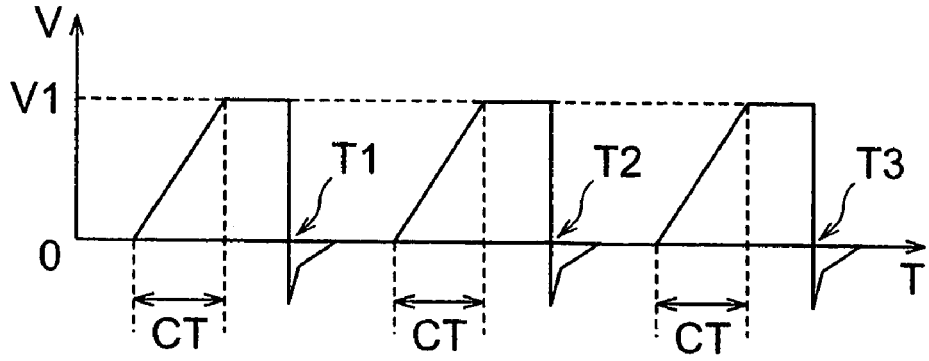
FIG. 2A to FIG. 2C are time charts showing time-variations of a voltage applied to the flash discharge tube, discharge current flowing in the flash discharge tube and current flowing in a surge current diode.
Figure 2B:
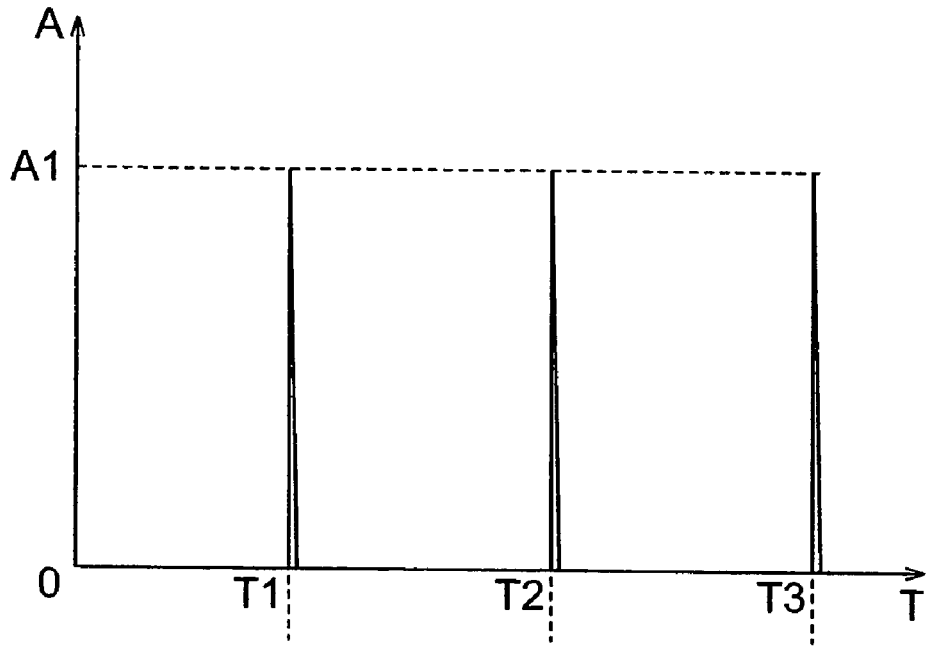
Figure 2C:
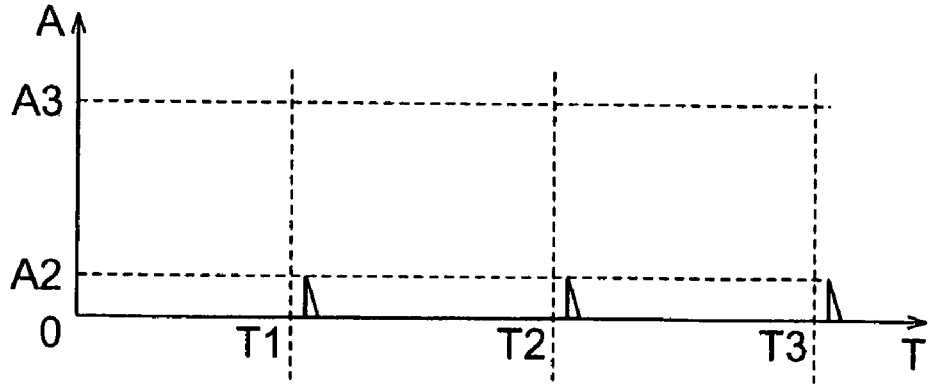

Next, the operation of the flash discharge tube apparatus 1 will be described with reference to FIG. 1 and FIG. 2A to FIG. 2C. FIG. 2A to FIG. 2C are time charts showing the operation of this apparatus 1. FIG. 2A shows the time-variation of a voltage applied to the positive electrode 11 of the flash discharge tube 5, FIG. 2B shows the time-variation of discharge current flowing in the flash discharge tube 5, and FIG. 2C shows the time-variation of current (surge current) flowing in the surge current diode 19. The rise time in the upper right direction of the waveform shown in FIG. 2A represents the charge time (CT) of the charge and discharge capacitor 17.

First, the switching element 37 is turned on, and the charge of the charge and discharge capacitor 17 is started by a voltage occurring in the transformer 23, that is, accumulation of the charges in the charge and discharge capacitor 17 is started. This is the start of the charge time (CT). The current generated by the voltage thus transformed by the transformer 23 mainly flows through the switching element 37 and then flows into the charge and discharge capacitor 17. Accordingly, even when the transformer protecting resistor 39 is connected to the secondary coil 27, the charge and discharge can be quickly charged.

After the charge and discharge capacitor 17 is charged until a nominal voltage (V1) is achieved, that is, after the charging time (CT) is passed, the switching element 37 is turned off. Even when the switching element 37 is turned off, the first coil portion 31 and second coil portion 33 of the secondary coil 27 are connected to each other through the transformer protecting resistor 39, and thus the following is satisfied. When the time period from the end of the charging of the charge and discharge capacitor 17 to the light emission of the flash discharge tube 5 is long, reduction of the voltage of the charge and discharge capacitor 17 due to spontaneous discharge of the charge and discharge capacitor 17 becomes large, and when the flash discharge tube 5 emits light with the voltage thus reduced, abnormal light having a weak light emission intensity is emitted. According to this embodiment, since the transformer protecting resistor 39 is connected to the circuit containing the discharge capacitor 5 and the transformer 23 connected to each other in series, the voltage occurring in the transformer 23 is allowed to be applied to the charge and discharge capacitor 17 during the period when the switching element 37 is turned off. Accordingly, the charge and discharge capacitor 17 can be charged to supplement the voltage corresponding to the spontaneous discharge of the charge and discharge capacitor 17.

Subsequently, a trigger voltage is applied to the trigger electrode 15 by the light emission trigger circuit 7 under the state where the switching element 37 is kept to be turned off, whereby insulation of xenon gas in the flash discharge tube 5 is broken. Accordingly, the charges accumulated in the charge and discharge capacitor 17 are supplied to the flash discharge tube 5, and the flash discharge tube 5 emits light (arc light emission) at the time T1.

After the light emission of the flash discharge tube 5, both the voltages at the positive electrode 11 side and the cathode 13 side should be equal to 0 volt. However, the voltage at the cathode 13 side is higher than the voltage at the positive electrode 11 side due to the energy accumulated in the residual inductance existing in the flash discharge tube apparatus 1. In order to overcome this state, the surge current is supplied to the circuit containing the flash discharge tube 5 and the surge current diode 19 connected to each other in series through the surge current diode 19 which is connected so as to be set in the forward direction under the above state. The above is one cycle of light emission, and the light emission operation is subsequently repeated in the same manner.

In this embodiment, the flash discharge tube 5 is actuated to emit light with large power such as 150 watts, and thus the energy accumulated in the residual inductance is increased, so that the surge current generated is equal to a large current of 100 amperes if normal. In this embodiment, the surge current diode 19 is connected to the diode protecting resistor 21 in series, and thus the surge current also flows in the diode protecting resistor 21. Accordingly, the peak value of the surge current flowing into the surge current diode 19 can be reduced, and heat generation, breakdown, etc., of the surge current diode 19 can be prevented. Therefore, it is unnecessary to increase the permissible current of the surge current diode 19, so that the surge current diode 19 can be downsized and thus the power supply circuit 3 for the flash discharge tube can be downsized.

When the resistance value of the diode protecting resistor 21 is excessively large, the surge current cannot be made to flow into the surge current diode 19. On the other hand, when the resistance value of the diode protecting resistor 21 is excessively small, the surge current is increased and the surge current diode 19 generates heat or the like. In consideration of these, the resistance value (for example, 50 ohms) of the diode protecting resistor 21 is determined.

When the surge current flows as counter current into the secondary coil 27 of the transformer 23, the transformer 23 generates heat and thus burnout or the like of the transformer 23 occurs if the value of the surge current is large. According to this embodiment, the circuit for connecting the charge and discharge capacitor 17 and the transformer 23 in series forms a closed loop by the transformer protecting resistor 39 even when the switching element 37 is turned off, and thus the counter current may flow. However, the resistance value (for example, 200 ohms) of the transformer protecting resistor 39 is selectively set so that the surge current is not prevented from flowing into the transformer protecting resistor 39, and thus even when the circuit concerned forms the closed loop, heat generation, failure, etc., of the transformer 23 can be prevented. However, if the heat quantity is equal to such a level that no trouble occurs, a resistance value at which the surge current flows in the secondary coil 27 may be selected.

Figure 3:
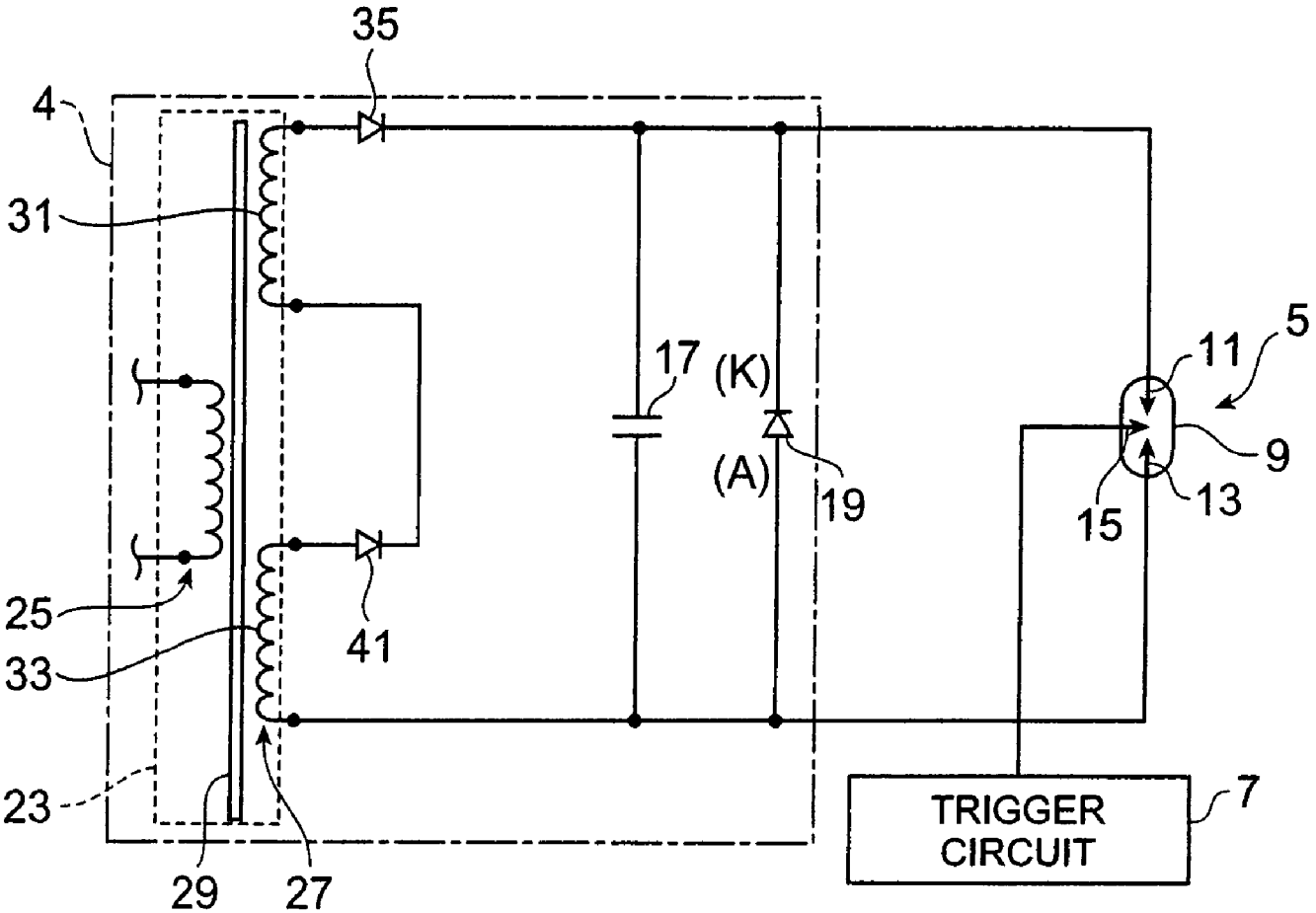
FIG. 3 is a circuit diagram showing the construction of a comparison example of the flash discharge tube apparatus.

Here, the main effect of this embodiment will be described by comparing it with comparative examples. First, the construction of the comparative examples will be briefly described. FIG. 3 is a circuit diagram showing the construction of a flash discharge tube apparatus including a power supply circuit 4 for a flash discharge tube as the comparison example. The point of difference in the power circuit 4 for the flash discharge tube of FIG. 3 from the power supply circuit 3 for the flash discharge tube of FIG. 1 resides in that the diode protecting resistor 21, the switching element 37 and the transformer protecting resistor 39 are not provided.

Figure 4A:
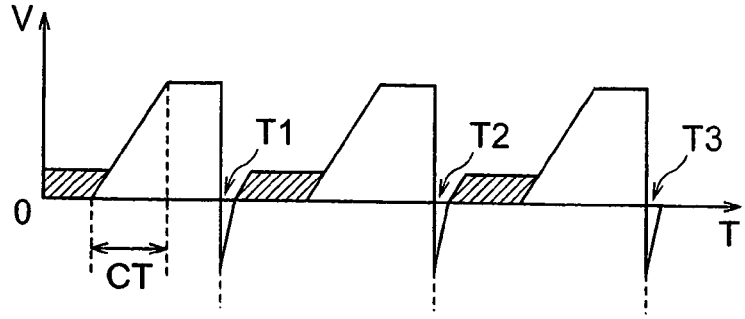
FIG. 4A to FIG. 4D are time charts showing time-variations of the voltage applied to the flash discharge tube, the discharge current flowing in the flash discharge tube, the current flowing in the surge current diode and current flowing in a transformer.
Figure 4B:
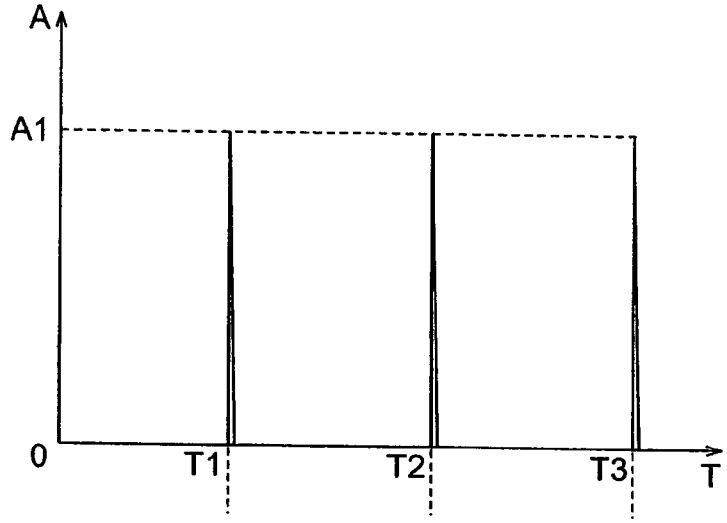
Figure 4C:
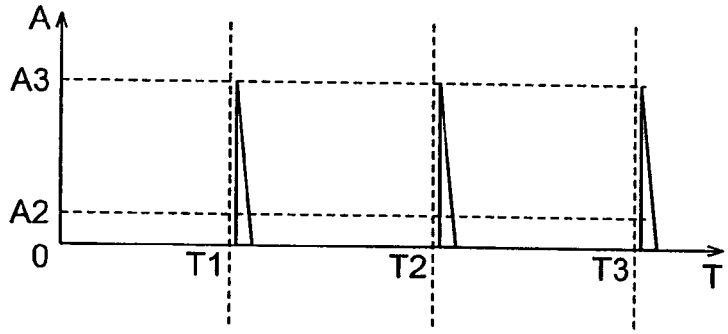
Figure 4D:
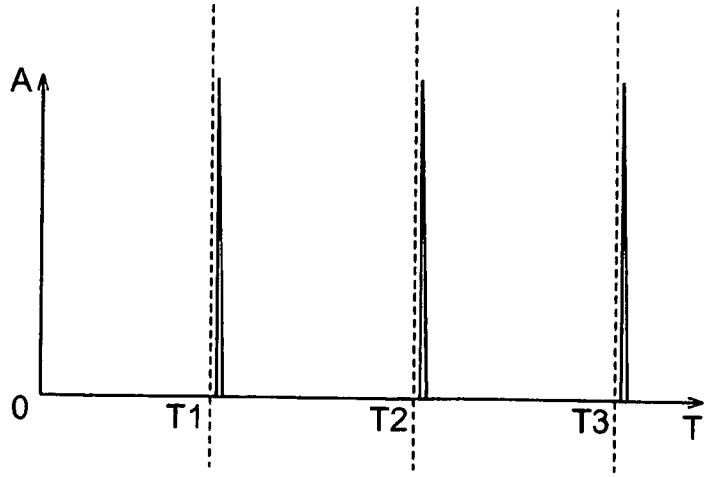

FIG. 4A to FIG. 4D are time charts showing the operation of the flash discharge tube apparatus according to the comparative examples. FIG. 4A corresponds to FIG. 2A, and it is a time chart of the voltage applied to the positive electrode 11 of the flash discharge tube 5. FIG. 4B corresponds to FIG. 2B, and it is a time chart of the discharge current flowing in the flash discharge tube 5. FIG. 4C corresponds to FIG. 2C, and it is a time chart of the current flowing in the surge current diode 19. FIG. 4D is a time chart of the current flowing in the secondary coil 27 of the transformer 23.

First, FIG. 2C (this embodiment) and FIG. 4C (comparative example) will be compared. As shown in FIG. 2C, according to this embodiment, the peak value of the surge current is equal to A2, and as shown in FIG. 4C, according to the comparative example, the peak value of the surge current is equal to A3. Here, the current value A2 of FIG. 2C and the current value A2 of FIG. 4C are the same value, and the current value A3 of FIG. 2C and the current value A3 of FIG. 4C are the same value. As described above, according to this embodiment, the diode protecting resistor 21 is connected to the surge current diode 19 in series, and thus it is apparent that the peak value of the surge current is smaller than that of the comparative example.

Furthermore, in the comparison example shown in FIG. 3, the surge current after the light emission of the flash discharge tube 5 flows in the secondary coil 27 of the transformer 23 as shown in FIG. 4D (comparative example). On the other hand, in this embodiment shown in FIG. 1, the switching element 37 is turned off and the resistance value of the transformer protecting resistor 39 is set to such a value that no surge current flows therethrough, so that the surge current can be prevented from flowing into the secondary coil 27 of the transformer 23. In this embodiment, the surge current does not flow into the secondary coil 27, and thus it is omitted from the illustration of the graph.

Furthermore, in the comparative example, an abnormal voltage occurs as shown in the place where the time period after the light emission of the flash discharge tube 5 to the start of the charging of the charge and discharge capacitor 17 is hatched as shown in FIG. 4A (comparative example). This is because energy is accumulated in the inductance of the transformer 23 due to the surge current flowing in the transformer 23 described with reference to FIG. 4D to generate a voltage in the transformer 23 and this voltage is applied as the abnormal voltage to the positive electrode 11 of the flash discharge tube 5. Immediately after the light emission of the flash discharge tube 5, the amount of residual ions in the flash discharge tube 5 is large, and thus when the abnormal voltage is applied to the positive electrode 11 and the cathode 13, abnormal light emission in which the intensity of light is small occurs. On the other hand, no surge current flows in the transformer 23 of this embodiment as shown in FIG. 2 (this embodiment), and thus no abnormal voltage occurs, so that the occurrence of abnormal light emission can be prevented.

Furthermore, comparing FIG. 2B (this embodiment) and FIG. 4B (comparative example), the peak value of the discharge current flowing into the flash discharge tube 5 is the same value (A1) therebetween, and according to this embodiment, the peak value of the discharge current which is similar to that of the comparative example can be achieved.

At the instant following the light emission of flash discharge tube 5, an abundance of ions generated by electrical discharge remain in the flash discharge tube 5. For emitting light repeatedly, the charging of charge and discharge capacitor 17 must be started after neutralization of such remaining ions to prevent abnormal light emission with such remaining ions. In a relatively brief period time after the light emission, the voltage at the cathode 13 of the flash discharge tube 5 becomes higher than the voltage at the anode 11 thereof. According to the present invention, the voltage difference between the cathode 13 and anode 11 becomes larger since the existence of the diode protecting resistor 21. Therefore, the time required for the neutralization of the remaining ions can be shortened. Accordingly, the waiting time to start the charging of the charge and discharge capacitor 17 can be shortened and the frequency of light emission can be heightened. It is effective for operating the discharge tube 5 with high electric power because the surge current becomes larger and the voltage difference can be larger with small resistance of diode protecting resistor 21. Consequently, the diode protecting resistor 21 makes reverse voltage for improving the neutralization of the remaining ions.

Figure 5:
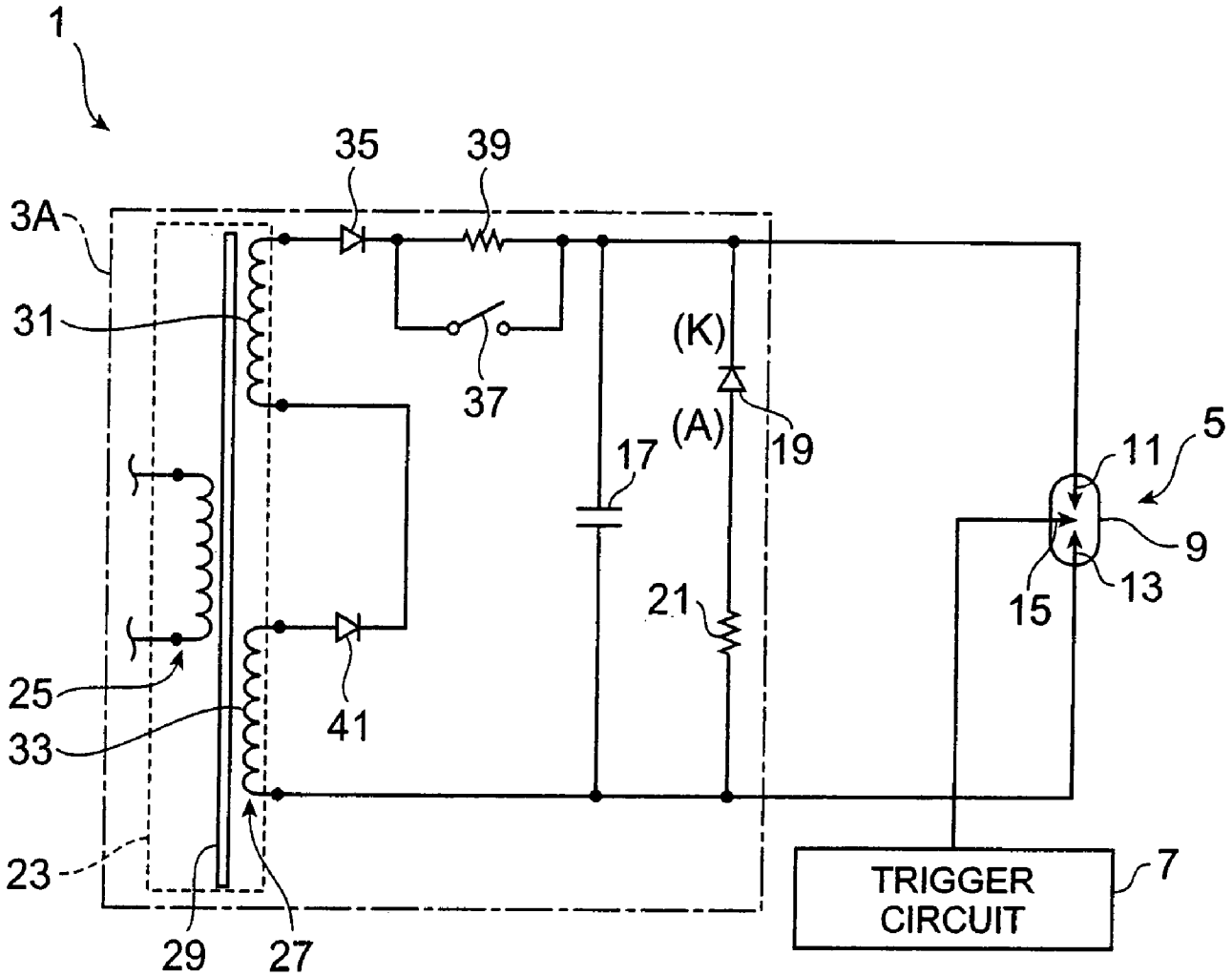
FIG. 5 to FIG. 9 are circuit diagrams showing the constructions of flash discharge tube apparatuses containing second to sixth embodiments of the power supply circuit for the flash discharge tube according to the present invention.

Next, another embodiment of the present invention will be described. FIG. 5 is a circuit diagram showing the construction of a flash discharge tube apparatus including a second embodiment of the power supply circuit for the flash discharge tube according to the present invention. The difference of the power supply circuit 3A for the flash discharge tube of FIG. 5 from the power supply circuit 3 for the flash discharge tube of FIG. 1 is that the rectifier diode 35 is connected to the charge and discharge capacitor 17, the cathode of the surge current diode 19 and the positive electrode 11 of the flash discharge tube 5 through the switching element 37 and the transformer protecting resistor 39 which are connected to each other in parallel, and the first coil portion 31 and the second coil portion 33 are connected to each other in series through the rectifying capacitor 41. That is, the parallel connection circuit of the switching element 37 and the transformer protecting resistor 39 is disposed at the high voltage side of the transformer 23.

Figure 6:
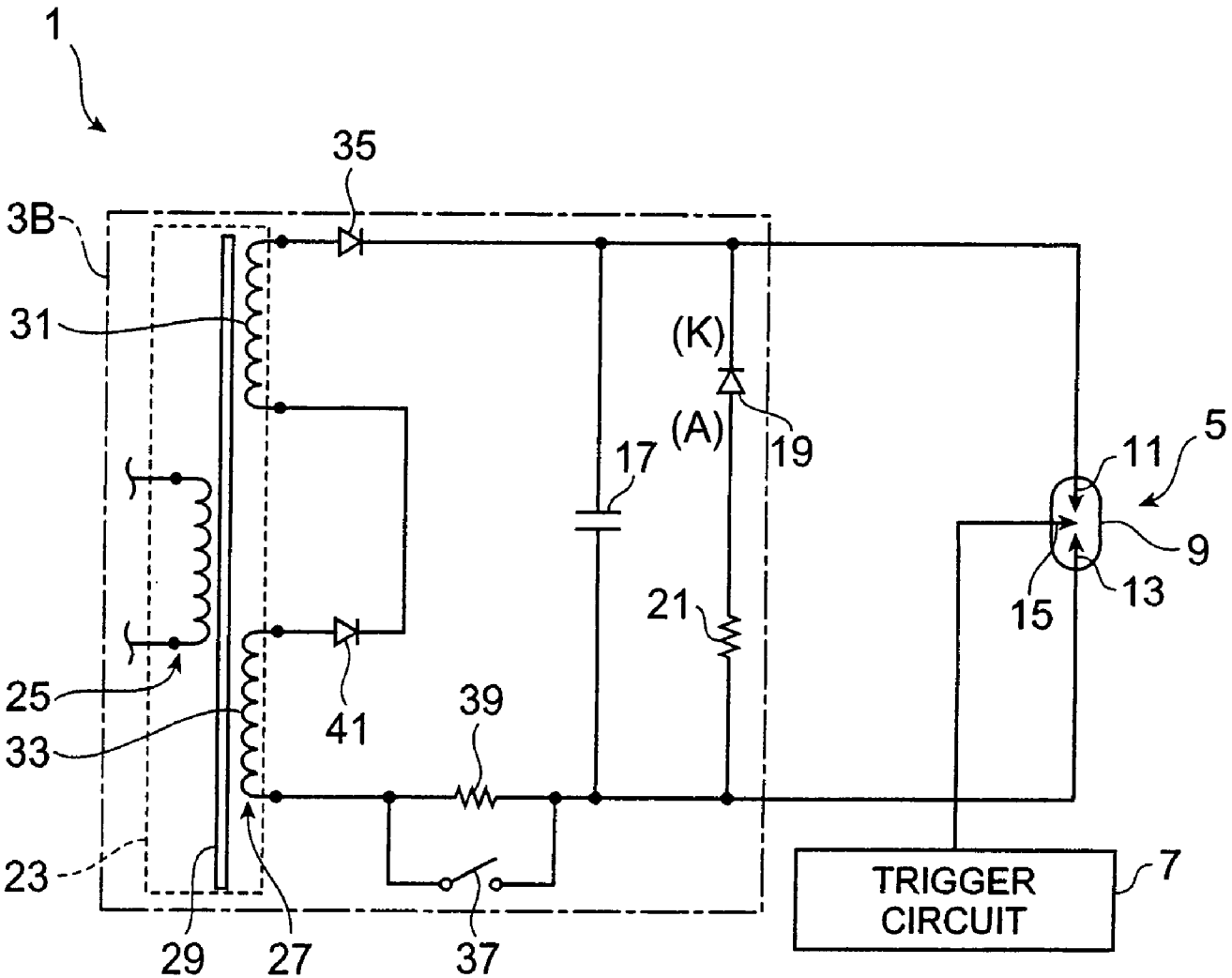

FIG. 6 is a circuit diagram showing the construction of a flash discharge tube apparatus including a third embodiment of the power supply circuit for the flash discharge tube according to the present invention. The difference of the power supply circuit 3B for the flash discharge tube of FIG. 6 from the power supply circuit 3 for the flash discharge tube of FIG. 1 is that the second coil portion 33 is connected to the charge and discharge capacitor 17, the diode protecting resistor 21 and the cathode 13 of the flash discharge tube 5 through the switching element 37 and the transformer protecting resistor 39 which are connected to each other in parallel, and the first coil portion 31 and the second coil portion 33 are connected to each other in series through the rectifying capacitor 41. That is, the parallel connection circuit of the switching element 37 and the resistor 39 is disposed at the low voltage side of the transformer 23.

Furthermore, the secondary coil 27 is not limited to the two-stage construction of the first coil portion 31 and the second coil portion 33, but it may be a three- or more stage construction. The parallel connection circuit of the switching element 37 and the transformer protecting resistor 39 may be disposed between one pair of adjacent coil portions. This will be described with reference to FIG. 7.

Figure 7:
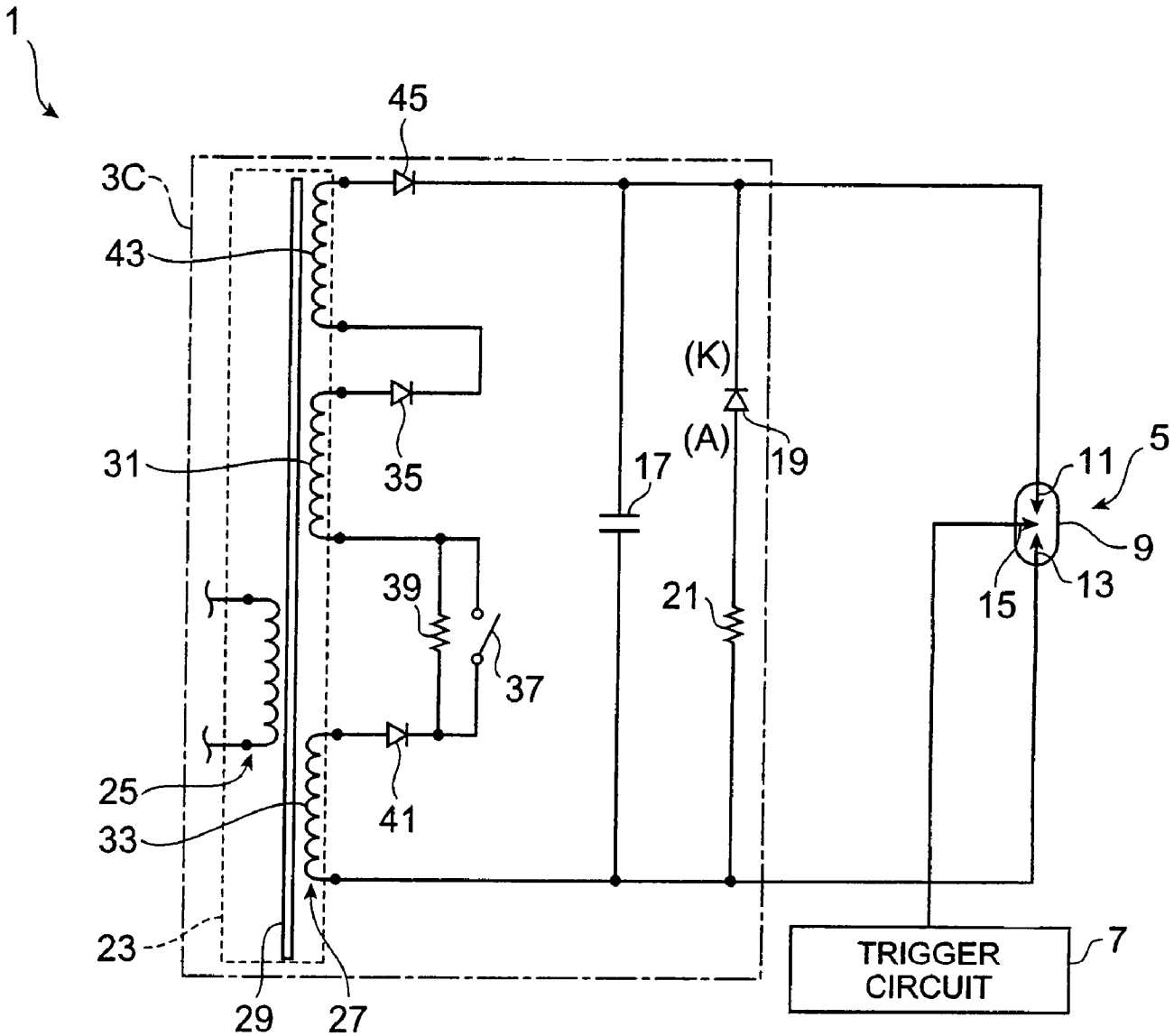

FIG. 7 is a circuit diagram showing the construction of a flash discharge tube apparatus including a fourth embodiment of the power supply circuit for the flash discharge tube according to the present invention. The secondary coil of the power supply circuit 3 for the flash discharge tube of FIG. 1 has a two-stage construction of the first coil portion 31 and the second coil portion 33. On the other hand, the secondary coil 27 of the power supply circuit 3C for the flash discharge tube of FIG. 12 has a three-stage construction of a first coil portion 31, a second coil portion 33 and a third coil portion 43. Specifically, one end portion of the third coil portion 43 is connected to the first coil portion 31 in series through the rectifier diode 35. The other end portion of the third coil portion 43 is connected to the anode of the rectifier diode 45. The cathode of the rectifier diode 45 is connected to the charge and discharge capacitor 17, the cathode of the surge current diode 19 and the positive electrode 11 of the flash discharge tube 5. The function of the rectifier diode 45 is the same as the rectifier diodes 35 and 41. The second to fourth embodiments have the same effect as the power supply circuit for the flash discharge tube of FIG. 1.

Figure 8:
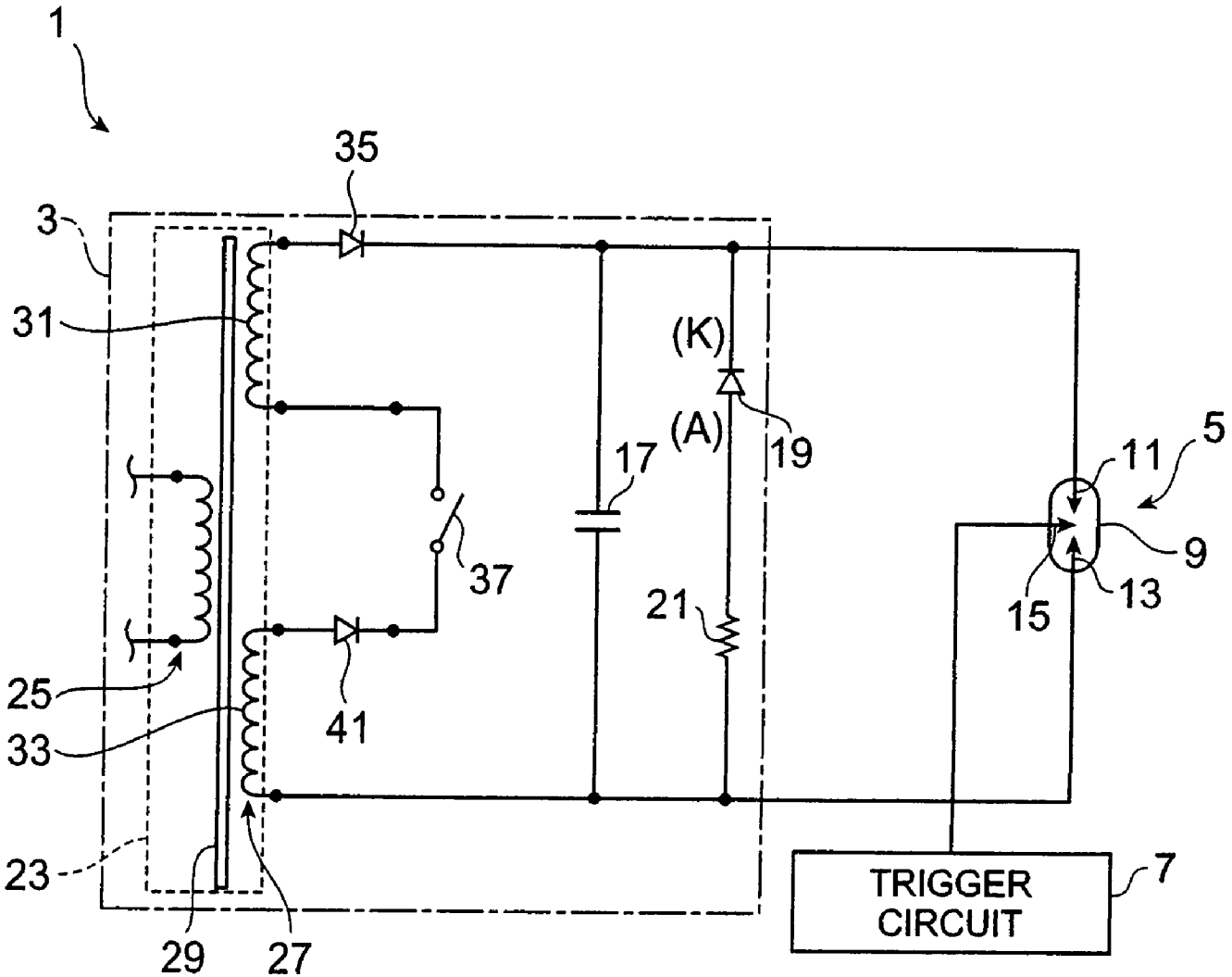

These embodiments have the switching element 37 and the transformer protecting resistor 39 which are connected to each other in parallel, however, it may be designed to have a circuit construction having no transformer protecting resistor 39. In a fifth embodiment shown in FIG. 8, the rectifier diode 41 and the switching element 37 are connected to each other in series, and the first coil portion 31 and the second coil portion 33 are connected to each other through the above series connection. According to this construction, by turning off the switching element 37 at the time when the surge current occurs, the surge current can be prevented from flowing in the secondary coil 27. As a result, heat generation, etc., of the transformer 23 can be prevented.

Figure 9:
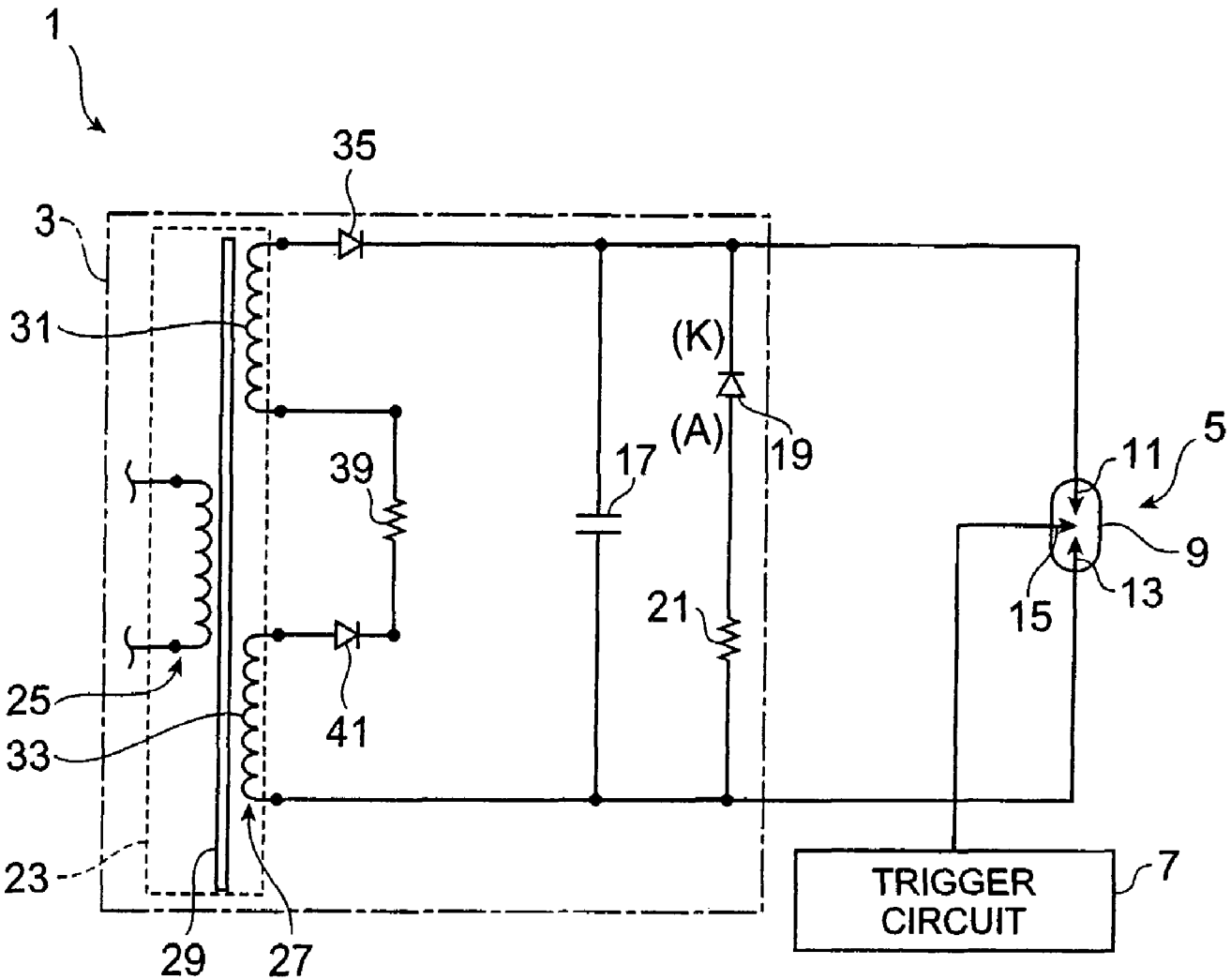

Furthermore, the circuit may be designed to have no switching element 37. That is, as shown in a sixth embodiment of FIG. 9, the rectifier diode 41 and the transformer protecting resistor 39 are connected to each other in series, and the first coil portion 31 and the second coil portion 33 are connected to each other through the above series connection. According to this construction, the surge current can be prevented from flowing in the secondary coil 27 by the transformer protecting resistor 39, so that heat generation, etc., of the transformer 23 can be prevented.

Still furthermore, if there occurs no heat generation problem of the transformer 23 by the surge current, neither the switching element 37 nor the transformer protecting resistor 39 is required. That is, the first coil portion 31 and the second coil portion 33 may be connected to each other in series through the rectifier diode 41.

The power supply circuit for the flash discharge tube according to the present invention is suitably applied as a power supply circuit for a flash discharge tube which is used as a light source for spectroscopic analysis, a light source for a flash lamp of a camera or a light source for a high-speed shutter camera.

What is claimed is:

1. A control circuit for a flash discharge tube using a charge and discharge capacitor to supply electrical charges for light emission of said flash discharge tube including a positive electrode, a negative electrode and a trigger electrode, comprising:

a surge circuit constituted by a first resistor and a diode connected in series, the diode being provided for surge current and the first resistor being provided for protection of the diode; and a light emission trigger circuit, directly connected to the trigger electrode, and connected to the surge circuit only via said flash discharge tube, for supplying a trigger voltage to the flash discharge tube;

wherein said surge circuit is disposed between said negative electrode and positive electrode of said flash discharge tube and connected in parallel to the charge and discharge capacitor; and wherein the cathode side of The diode is connected to The positive electrode side of the flash discharge tube.

2. The circuit according to claim 1, further comprising:

a transformer disposed between said charge and discharge capacitor and a power source to boost the voltage supplied to the charge and discharge capacitor; and a switching element connected in series in the circuit formed by said transformer and said charge and discharge capacitor, and controlled so as to be turned on during the charging of said charge and discharge capacitor and turned off in other cases.

3. The circuit according to claim 2, further comprising a second resistor connected to the switching element in parallel.

4. The circuit according to claim 1, further comprising:

a transformer disposed between said charge and discharge capacitor and a power source to boost the voltage supplied to said charge and discharge capacitor; and a second resistor connected in series in the circuit formed by said transformer and said charge and discharge capacitor.

* * * * *